US010641269B2

(12) United States Patent
Ma et al.

(10) Patent No.: US 10,641,269 B2
(45) Date of Patent: May 5, 2020

(54) LUBRICATION OF SCROLL COMPRESSOR

(71) Applicant: Emerson Climate Technologies (Suzhou) Co., Ltd., Jiangsu (CN)

(72) Inventors: Wenrui Ma, Jiangsu (CN); Yinglin Yu, Jiangsu (CN); Peilong Dong, Jiangsu (CN); Sheng Liang, Jiangsu (CN); Yonghua Cui, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 165 days.

(21) Appl. No.: 15/569,350

(22) PCT Filed: Feb. 29, 2016

(86) PCT No.: PCT/CN2016/074823
§ 371 (c)(1),
(2) Date: Oct. 25, 2017

(87) PCT Pub. No.: WO2016/173319
PCT Pub. Date: Nov. 3, 2016

(65) Prior Publication Data

US 2018/0080448 A1 Mar. 22, 2018

(30) Foreign Application Priority Data

Apr. 30, 2015 (CN) ..... 2015 1 0216987
Apr. 30, 2015 (CN) ..... 2015 2 0276001 U

(51) Int. Cl.
*F04C 29/02* (2006.01)
*F04C 23/00* (2006.01)
(Continued)

(52) U.S. Cl.
CPC ..... *F04C 29/028* (2013.01); *F04C 18/0215* (2013.01); *F04C 18/0253* (2013.01); *F04C 23/008* (2013.01); *F04C 29/0057* (2013.01)

(58) Field of Classification Search
CPC ..... F04C 18/0215; F04C 18/0253; F04C 29/025; F04C 29/028
See application file for complete search history.

(56) References Cited

U.S. PATENT DOCUMENTS 4,596,521 A 6/1986 Murayama et al.
4,669,962 A 6/1987 Mizuno et al.
(Continued)

FOREIGN PATENT DOCUMENTS

CN 1215806 A 5/1999
CN 1533480 A 9/2004
(Continued)

OTHER PUBLICATIONS

Machine Translation of JP 11-247772, Inventor: Ishikawa, Title: Scroll Fluid Machine, JP published on Sep. 14, 1999 (Year: 1999).*
(Continued)

*Primary Examiner* — Mary Davis
(74) *Attorney, Agent, or Firm* — Harness, Dickey & Pierce, P.L.C.

(57) ABSTRACT

A scroll compressor is provided, including: a compression mechanism, a driving mechanism, a suction fitting and a lubrication system. The compression mechanism is adapted to compress working fluid and includes a movable scroll component, a fixed scroll component and a suction window, the working fluid flows into the compression mechanism via the suction window. The driving mechanism includes a driving shaft and is adapted to drive the compression mechanism. The working fluid flows into the scroll compressor via the suction fitting and then flow into the compression mechanism. The lubrication system includes a lubricant source and a compression mechanism oil supply device adapted to supply the lubricant to the compression mechanism from the lubricant source. The compression mechanism oil supply device has an oil supply passage and an
(Continued)

outflow opening of the oil supply passage is located between an opening of the suction fitting and the suction window.

20 Claims, 6 Drawing Sheets

(51) Int. Cl.
*F04C 18/02* (2006.01)
*F04C 29/00* (2006.01)

(56) References Cited

U.S. PATENT DOCUMENTS

| | | | | |
|---|---|---|---|---|
| 4,743,181 | A | 5/1988 | Murayama et al. | |
| 4,877,382 | A | 10/1989 | Caillat et al. | |
| 5,102,316 | A | 4/1992 | Caillat et al. | |
| 5,176,506 | A | 1/1993 | Siebel | |
| 5,263,822 | A | 11/1993 | Fujio | |
| 5,320,506 | A | 6/1994 | Fogt | |
| 5,379,516 | A | 1/1995 | Vaccaro et al. | |
| 5,395,224 | A | 3/1995 | Caillat et al. | |
| 5,803,722 | A | 9/1998 | Noboru et al. | |
| 5,810,573 | A | 9/1998 | Mitsunaga et al. | |
| 6,071,100 | A | 6/2000 | Yamada et al. | |
| 6,074,186 | A | 6/2000 | Lifson et al. | |
| 6,273,691 | B1 | 8/2001 | Morimoto et al. | |
| 6,375,444 | B1 | 4/2002 | Dewar | |
| 6,422,843 | B1 | 7/2002 | Sun et al. | |
| 6,533,561 | B1 | 3/2003 | Furusho et al. | |
| 6,893,235 | B2 | 5/2005 | Furusho et al. | |
| 6,932,586 | B2 | 8/2005 | Furusho et al. | |
| 7,322,809 | B2 | 1/2008 | Kitaura et al. | |
| 7,458,789 | B2 | 12/2008 | Hiwata et al. | |
| 7,614,859 | B2 | 11/2009 | Sawai et al. | |
| 7,699,591 | B2 | 4/2010 | Futagami et al. | |
| 7,837,452 | B2 | 11/2010 | Ignatiev et al. | |
| 8,070,465 | B2 | 12/2011 | Ginies et al. | |
| 8,303,280 | B2 | 11/2012 | Kiyokawa et al. | |
| 8,348,647 | B2 | 1/2013 | Kiyokawa et al. | |
| 8,585,381 | B2 | 11/2013 | Kiyokawa et al. | |
| 8,992,191 | B2 | 3/2015 | Ahn et al. | |
| 9,133,843 | B2 | 9/2015 | Tsuka et al. | |
| 9,181,945 | B2 | 11/2015 | Takeda et al. | |
| 9,316,225 | B2 | 4/2016 | Nagahara et al. | |
| 9,759,216 | B2 | 9/2017 | Kato | |
| 10,036,388 | B2 | 7/2018 | Akei et al. | |
| 2002/0136652 | A1 | 9/2002 | Gennami et al. | |
| 2003/0063983 | A1 | 4/2003 | Ancel et al. | |
| 2004/0247474 | A1 | 12/2004 | Kitaura et al. | |
| 2004/0265159 | A1 | 12/2004 | Furusho et al. | |
| 2006/0006598 | A1 | 1/2006 | Kimura et al. | |
| 2007/0092390 | A1 | 4/2007 | Ignatiev et al. | |
| 2008/0267803 | A1* | 10/2008 | Yoo | F04C 18/0215 418/55.1 |
| 2009/0162231 | A1 | 6/2009 | Liang et al. | |
| 2010/0212352 | A1 | 8/2010 | Kim et al. | |
| 2011/0011123 | A1 | 1/2011 | Matsuura et al. | |
| 2012/0258004 | A1 | 10/2012 | Ignatiev et al. | |
| 2013/0189080 | A1 | 7/2013 | Nakai et al. | |
| 2014/0017108 | A1 | 1/2014 | Uekawa et al. | |
| 2014/0248169 | A1 | 9/2014 | Uekawa | |
| 2015/0030487 | A1 | 1/2015 | Toyama et al. | |
| 2015/0139844 | A1 | 5/2015 | Akei et al. | |
| 2016/0187173 | A1 | 6/2016 | Jang et al. | |
| 2017/0051742 | A1 | 2/2017 | Tang et al. | |
| 2017/0146265 | A1 | 5/2017 | Fujitaka et al. | |
| 2018/0335036 | A1 | 11/2018 | Akei et al. | |

FOREIGN PATENT DOCUMENTS

| | | | |
|---|---|---|---|
| CN | 101663485 | A | 3/2010 |
| CN | 102454603 | A | 5/2012 |
| CN | 202250844 | U | 5/2012 |
| CN | 202250848 | U | 5/2012 |
| CN | 202266436 | U | 6/2012 |
| CN | 202597102 | U | 12/2012 |
| CN | 204126898 | U | 1/2015 |
| CN | 204646671 | U | 9/2015 |
| JP | H03-105092 | A | 5/1991 |
| JP | H03-237287 | A | 10/1991 |
| JP | H11-247772 | A | 9/1999 |
| JP | H11-247780 | A | 9/1999 |
| JP | 2001-234879 | A | 8/2001 |
| JP | 2001-234880 | A | 8/2001 |
| JP | 2011052576 | A | 3/2011 |
| JP | 2012215174 | A | 11/2012 |
| KR | 20020068634 | A | 8/2002 |
| KR | 20070061966 | A | 6/2007 |
| WO | WO-2012132436 | A1 | 10/2012 |

OTHER PUBLICATIONS

International Search Report for PCT/CN2016/074823, ISA/CN, Haidian District, Beijing, dated May 27, 2016, in Chinese and English.

Written Opinion of the ISA for PCT/CN2016/074823, ISA/CN, Haidian District, Beijing, dated May 27, 2016, in Chinese.

International Search Report regarding International Application No. PCT/CN2014/080951, dated Sep. 29, 2014.

Written Opinion of the International Searching Authority regarding International Application No. PCT/CN2014/080951, dated Sep. 29, 2014.

Office Action regarding Chinese Patent Application No. 201410302694.4, dated Dec. 31, 2015. Translation provided by Unitalen Attorneys at Law.

Office Action regarding Chinese Patent Application No. 201410302694.4, dated Sep. 5, 2016. Translation provided by Unitalen Attorneys at Law.

Restriction Requirement regarding U.S. Appl. No. 14/413,204, dated Aug. 25, 2017.

Office Action regarding U.S. Appl. No. 14/413,204, dated Nov. 29, 2017.

Interview Summary regarding U.S. Appl. No. 14/413,204, dated Jan. 23, 2018.

Notice of Allowance regarding U.S. Appl. No. 14/413,204, dated Jun. 19, 2018.

Office Action regarding U.S. Appl. No. 16/047,675, dated Jul. 2, 2019.

Office Action regarding Chinese Patent Application No. 201510216987.5, dated Dec. 5, 2017. Translation provided by Unitalen Attorneys at Law.

Interview Summary regarding U.S. Appl. No. 16/047,675, dated Sep. 4, 2019.

Notice of Allowance regarding U.S. Appl. No. 16/047,675, dated Jan. 27, 2020.

* cited by examiner

LUBRICATION OF SCROLL COMPRESSOR

This application is the national phase of International Application No. PCT/CN2016/074823, titled "SCROLL COMPRESSOR", filed on Feb. 9, 2016, which claims the benefit of priorities to Chinese Patent Application No. 201510216987.5 titled "SCROLL COMPRESSOR", filed with the Chinese State Intellectual Property Office on Apr. 30, 2015, and Chinese Patent Application No. 201520276001.9 titled "SCROLL COMPRESSOR", filed with the Chinese State Intellectual Property Office on Apr. 30, 2015, the entire disclosures of which are incorporated herein by reference.

FIELD OF THE INVENTION

The present application relates to a scroll compressor, and more particularly to a scroll compressor having an improvement in terms of appropriate oil supply for its compression mechanism oil supply device.

BACKGROUND OF THE INVENTION

Compressors (such as scroll compressors) can be used in, for example, cooling (freezing or refrigeration) systems, air conditioning systems and heat pump systems. The scroll compressor includes a compression mechanism for compressing a working fluid (such as a refrigerant), and the compression mechanism in turn includes an orbiting scroll set and a non-orbiting scroll set. When the scroll compressor is in operation, there is a relative movement between the orbiting scroll set and the non-orbiting scroll set of the compression mechanism. In order to reduce abrasion and power consumption, it is necessary to provide lubrication to the compression mechanism (for example, supplying lubricating oil) to mitigate the friction between the orbiting scroll set and the non-orbiting scroll set, and the resulting oil film can also improve the sealability of the compression mechanism, thereby increasing the volumetric efficiency and the like.

In general, an oil circulation rate can be used to represent the amount of lubricating oil carried by the working fluid, and correspondingly, the oil circulation rate can be used to represent the degree of lubricating oil supply to the compression mechanism. Too much or too little supply of lubricating oil will adversely affect the normal operation, the system performance and the like of the compression mechanism itself. For example, an excessively large oil circulation rate will reduce the heat transfer efficiency of the system and will also cause the lubricating oil to accumulate around (especially above) the discharge valve assembly (such as the HVE valve assembly) at a discharge port and a discharge recessed portion of the non-orbiting scroll set, so as to cause certain issues to the scroll compressor (such as the issue of operational stability of the discharge valve assembly and/or the issue of exhaust reliability of the compression mechanism).

In addition, for a system where a variable speed compressor is used (the variable speed compressor needs to operate at different speeds) and/or the system needs to operate under different parameters (especially at different evaporation temperatures), it is desirable to provide a compression mechanism oil supply device with which the oil circulation rate is enabled to be within an appropriate range at different compressor rotational speeds and/or under different system operating parameters.

Further, in the case of a constant speed compressor, it is also desirable to provide a compression mechanism oil supply device with an excellent versatility and applicable to a series of constant speed compressors having different rotational speeds, and the compression mechanism oil supply device can provide oil circulation rates within appropriate ranges for the constant speed compressors at respective different rotational speeds.

Here, it should be noted that the technical contents provided in this section are intended to facilitate the understanding of the present application by the person skilled in the art and do not necessarily constitute the prior art.

SUMMARY OF THE INVENTION

A general summary, rather than the full scope or all the features, of the present application is provided in this section.

An object of the present application is to provide a scroll compressor having a compression mechanism oil supply device capable of achieving an oil supply target and concept of taking oil on demand.

Another object of the present application is to provide a scroll compressor having a compression mechanism oil supply device enabling an oil circulation rate to be within an appropriate range at different compressor rotational speeds and/or under different system operating parameters.

Another object of the present application is to provide a scroll compressor having a compression mechanism oil supply device capable of effectively preventing an oil circulation rate from significantly exceeding an upper limit of a desired range at a low evaporation temperature/low compressor rotational speed.

Another object of the present application is to provide a scroll compressor having a compression mechanism oil supply device capable of sufficiently improving the adjustment accuracy and design freedom of the oil circulation rate.

In order to achieve one or more of the above objects, according to the present application, a scroll compressor is provided, which includes: a compression mechanism, a drive mechanism, a suction fitting, and a lubrication system. The compression mechanism is adapted to compress a working fluid and includes an orbiting scroll set, a non-orbiting scroll set and a suction window, and the working fluid can flow into the compression mechanism via the suction window. The drive mechanism includes a drive shaft and is adapted to drive the compression mechanism. Via the suction fitting the working fluid can flow into the scroll compressor and can further flow to the compression mechanism. The lubrication system includes a lubricant source and a compression mechanism oil supply device adapted to supply a lubricant from the lubricant source to the compression mechanism. The compression mechanism oil supply device has an oil supply passage, and an outflow opening of the oil supply passage is located between an opening of the suction fitting and the suction window.

According to the present application, during the operation of the scroll compressor, when the lubricant from the lubricant source is discharged from the opening of the transverse hole, the lubricant discharged meets the suctioned low pressure working fluid, so that the low pressure working fluid can bring a portion of the lubricant into the compression mechanism. In this way, the oil supply target and concept of taking oil on demand (that is, the so-called taking depending on demand) are realized.

Specifically, on the one hand, for example, in the case of a low rotational speed condition, it is possible to increase an oil circulation rate to make it within a desired range as compared with a solution in which an active oil injection mechanism for supplying oil to the compression mechanism is not provided. On the other hand, for example, in the case of a high rotational speed condition, the oil circulation rate will not be excessively increased (basically the oil circulation rate may be only slightly increased) and may be kept within a desired range (for example, this is because at a high rotational speed, the mass of the lubricant expelled out of the orbiting scroll base plate is relatively small at each revolution of the compression mechanism). Thereby, the oil circulation rate can be made within an appropriate range at different compressor rotational speeds and/or under different system operation parameters. In particular, it is possible to effectively prevent the oil circulation rate from significantly exceeding an upper limit of the desired range at a low evaporation temperature/low compressor rotational speed. Therefore, it is possible to avoid an excessively high oil circulation rate which causes the lubricant to accumulate around the discharge valve assembly and brings stability and reliability issues to the scroll compressor.

In addition, according to the present application, a counterbore having a larger inner diameter is provided, an outlet hole is provided and/or a plug having a through hole with a smaller inner diameter is provided, thus, the adjustment accuracy and design freedom of the oil circulation rate can be sufficiently improved, thereby enabling the compression mechanism oil supply device to have a more excellent versatility and applicability.

BRIEF DESCRIPTION OF THE DRAWINGS

The features and advantages of one or more embodiments of the present application will become more readily understood from the following description with reference to the accompanying drawings in which.

DETAILED DESCRIPTION

The present application is described in detail hereinafter by means of exemplary embodiments with reference to the accompanying drawings. The following detailed description of the present application is for illustrative purpose only and is by no means intended to limit the present application and the applications or usages thereof.

Figure 1:
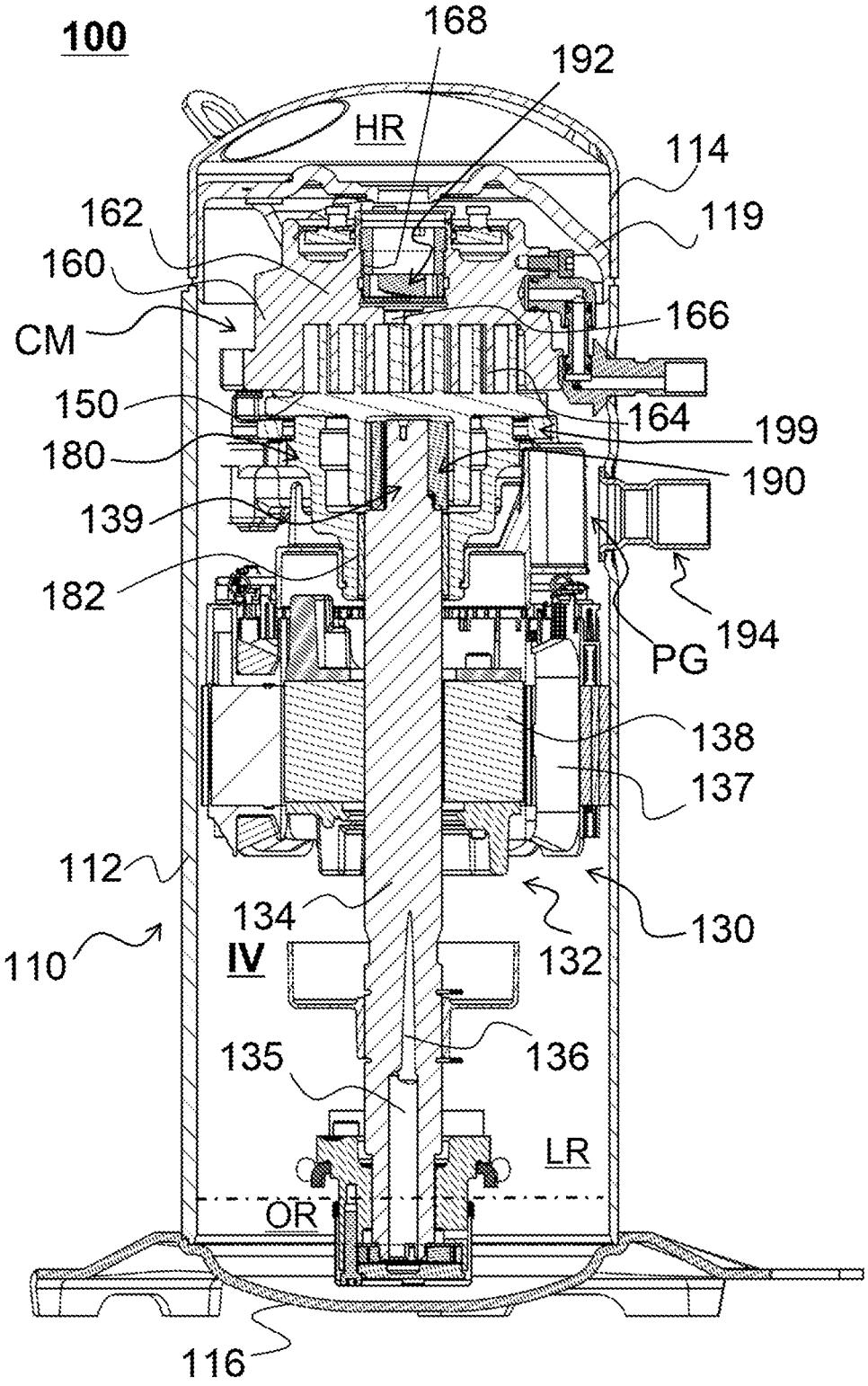
FIG. 1 is a longitudinal sectional view showing a scroll compressor to which a compression mechanism oil supply device according to the present application is applied.

First, a structure of a scroll compressor to which a compression mechanism oil supply device according to the present application is applied is briefly described with reference to FIG. 1 (FIG. 1 is a longitudinal sectional view showing the scroll compressor to which the compression mechanism oil supply device according to the present application is applied).

As shown in FIG. 1, the scroll compressor 100 may include a shell 110. The shell 110 may include a generally cylindrical shell body 112, a top cap 114 mounted to the top of the shell body 112, and a bottom cap 116 mounted to the bottom of the shell body 112. The shell 110 defines an internal volume IV of the scroll compressor 100. In addition, a partition plate 119 may be provided within the shell 110 so that the partition plate 119 and the top cap 114 define a high pressure region HR (the high pressure region HR is adapted to temporarily store a high pressure working fluid to be discharged to the outside of the compressor), and the partition plate 119, the shell body 112 and the bottom cap 116 define a low pressure region LR. In addition, lubricants such as lubricating oil may be stored in an oil sump OR at the bottom of the internal volume IV within the shell 110. In the illustrated example, the scroll compressor is a so-called low side scroll compressor.

The scroll compressor 100 may further include a suction fitting 194. In the illustrated example, the scroll compressor 100 may employ a middle air intake design, i.e., the suction fitting 194 is arranged at a position substantially aligning to the main bearing housing 180 in an axial direction of the compressor. Thus, the working fluid with low temperature and low pressure after being evaporated by an evaporator can be suctioned into the scroll compressor 100 via the suction fitting 194 for being compressed.

The scroll compressor 100 may further include a drive mechanism 130. The drive mechanism 130 may include an electric motor 132 and a drive shaft 134. The electric motor 132 may include a stator 137 and a rotor 138. The stator 137 may be fixedly connected to an inner peripheral wall surface of the shell body 112, and the rotor 138 may be fixedly sleeved on the drive shaft 134 to rotate integrally with the drive shaft 134. An eccentric pin 139 may be provided at a top end of the drive shaft 134. Here, it should be understood that other drive mechanisms that do not have an electric motor may also be used.

The scroll compressor 100 may further include a main bearing housing 180. The main bearing housing 180 may be fixedly connected to the inner peripheral wall surface of the shell body 112. For example, the main bearing housing 180 may be fixedly connected to the inner peripheral wall surface of the shell body 112 by means of its multiple circumferentially spaced apart radial projections such that multiple main bearing passageways PG are formed between the main bearing housing 180 and the inner peripheral wall surface of the shell body 112 (i.e., between adjacent radial projections of the main bearing housing 180) for, for example, allowing passage of a low pressure working fluid suctioned into the internal volume IV. The main bearing housing 180 is adapted to support a portion of the drive shaft 134 via a main bearing 182 disposed in the main bearing housing 180.

The scroll compressor 100 may further include a compression mechanism CM adapted to compress a working fluid, such as a refrigerant. The compression mechanism CM may include an orbiting scroll set 150 and a non-orbiting scroll set 160. In some examples, the compression mechanism CM may be embodied as an asymmetric compression mechanism.

The orbiting scroll set 150 may include a base plate 152, a spiral orbiting scroll 154 extending upward from a radial central portion of an upper surface of the base plate 152, and a hub 156 extending downward from a radial central portion of a lower surface of the base plate 152. The orbiting scroll set 150 may be arranged in the main bearing housing 180 and is axially supported by the main bearing housing 180 so that the orbiting scroll set 150 can be orbited. The eccentric pin 139 may be drivingly coupled to (inserted into) the hub 156 (e.g., via an unloading bushing 190 and/or a drive bearing).

The non-orbiting scroll set 160 may include a base plate 162, a spiral non-orbiting scroll 164 extending downward from a lower surface of the base plate 162, a discharge port 166 formed at substantially the center of the base plate 162 and adapted to be in communication with the central high pressure chamber of the compression mechanism CM; and a recessed portion 168 formed at substantially the center of the base plate 162. The recessed portion 168 is located above the discharge port 166 and is adapted to be in communication with the discharge port 166 and the high pressure region HR. A discharge valve assembly (e.g., an HVE valve assembly) 192 may be provided in the recessed portion 168 to control the exhaust of the compression mechanism CM. In the illustrated example, the non-orbiting scroll 164 may include an (annular) outer wall 164*a* at its radial outermost part, and a compression mechanism suction window SW may be provided in the outer wall 164*a* at an appropriate circumferential position, the suction window SW allows the low pressure working fluid to be suctioned into the compression mechanism CM.

The non-orbiting scroll 164 is adapted to engage the orbiting scroll 154, thereby defining a series of crescent-shaped working fluid accommodating chambers. These accommodating chambers may include an unsealed suction accommodating chamber SC which is being fed with air and has a low pressure, a sealed compression accommodating chamber which is compressing and has an increased pressure, and a central high pressure chamber which has finished compressing and is exhausting air via the discharge port 166 and the discharge valve assembly 192. The suction accommodating chamber SC is adapted to be in communication with the suction window SW so as to be enabled to receive the low-pressure working fluid suctioned from the suction window SW.

The scroll compressor 100 may further include a lubrication system that is primarily intended to provide lubrication to the respective relatively-moving components of the compressor (such as the compression mechanism CM, the main bearing 182, the eccentric pin 139, the unloading bushing 190, and the drive bearing). The lubrication system may include: an oil sump OR (main lubricant source) as mentioned above; an oil supply passage provided in the drive shaft 134 and including a central hole 135 located in a lower part of the drive shaft and an eccentric hole 136 located in an upper part of the drive shaft; a lubricant storage area (auxiliary lubricant source) for lubricating the eccentric pin 139 and for temporarily storing the lubricant temporarily remained within the main bearing housing 180 after lubricating the lubricating eccentric pin 139, the unloading bushing 190, the drive bearing and/or the main bearing 182; a compression mechanism oil supply device CO (not shown in FIG. 1 but referring to FIGS. 2 and 5) configured to supply lubricant from, for example, the lubricant storage area to the compression mechanism CM; and an oil return passage allowing the lubricant to return from, for example, the lubricant storage area to the oil sump OR. Here, it should be noted that, the oil sump OR and/or the lubricant storage area serves as lubricant sources according to the present application.

In some examples, the lubricant storage area may include a lubricant storage area OA located between a lower surface of the orbiting scroll base plate 152 and top end faces of the eccentric pin 139, the unloading bushing 190 and/or the drive bearing and located in the hub 156.

When the scroll compressor 100 operates, the electric motor 132 is energized to rotate the rotor 138 integrally with the drive shaft 134. At this time, the eccentric pin 139, for example integrally formed with the drive shaft 134, is also rotated to drive the hub 156, for example, via the unloading bushing 190 and/or the drive bearing, whereby the orbiting scroll set 150 is revolved, i.e., orbited with respect to the non-orbiting scroll set 160 by means of, for example, an Oldham 199 (that is, the axis of the orbiting scroll set 150 is revolved with respect to the axis of the non-orbiting scroll set 160, however, the orbiting scroll set 150 and the non-orbiting scroll set 160 are not rotated about their respective axes). At the same time, the low pressure working fluid suctioned from the suction fitting 194 can pass through the main bearing housing 180 along the main bearing housing passages PG and then enter the compression mechanism CM (specifically, entering the suction accommodating chamber SC) via the suction window SW.

Accordingly, the accommodating chambers defined by the non-orbiting scroll 164 and the orbiting scroll 154 are changed from the unsealed suction accommodating chamber SC to the compression accommodating chamber and then to the central high pressure chamber (with the highest pressure) in the process of moving from the radial outer side to the radial inner side, and the volumes thereof gradually become smaller. In this way, the pressure in the accommodating chambers is gradually increased so that the working fluid is compressed and finally discharged from the discharge port 166 to the high pressure region HR and further discharged to the outside of the compressor via a discharge fitting (not shown).

At the same time, for example, the lubricant can be conveyed from the oil sump OR through the oil supply passage (specifically, the central hole 135 and the eccentric hole 136) to the lubricant storage area (such as the lubricant storage area OA) with the effect of the centrifugal force generated due to the rotation of the drive shaft 134. Then, through the compression mechanism oil supply device CO, a part of the lubricant temporarily stored in the lubricant storage area OA is supplied to the compression mechanism CM (for example, supplied to an appropriate area of the suction accommodating chamber SC) so as to provide lubrication to the compression mechanism CM. Then, the remaining lubricant temporarily stored in the lubricant storage area OA returns to the oil sump OR through the oil return passage.

Figure 6:
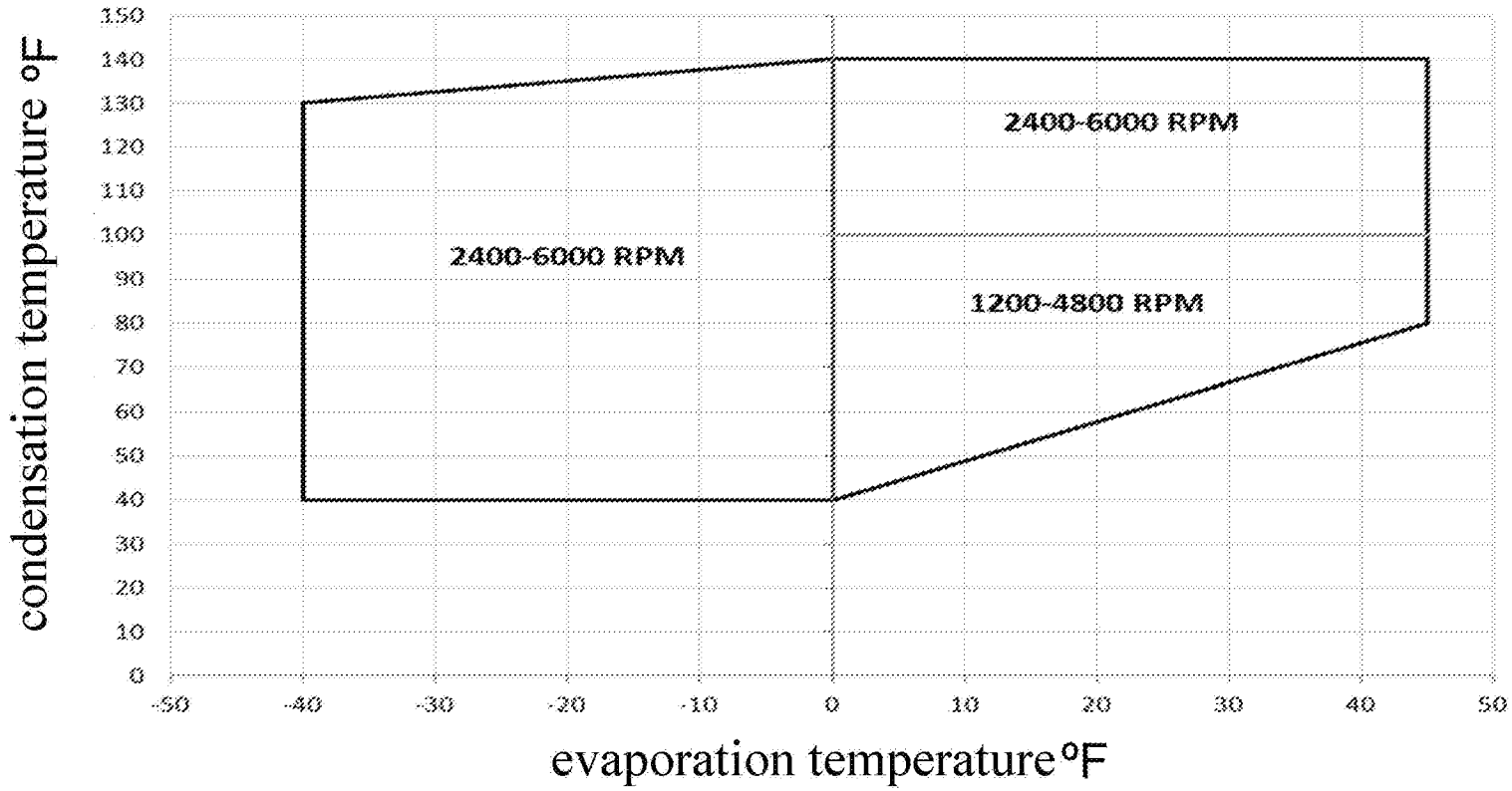
FIG. 6 is a schematic diagram showing exemplary parameter ranges of an exemplary cooling system.
Figure 7:
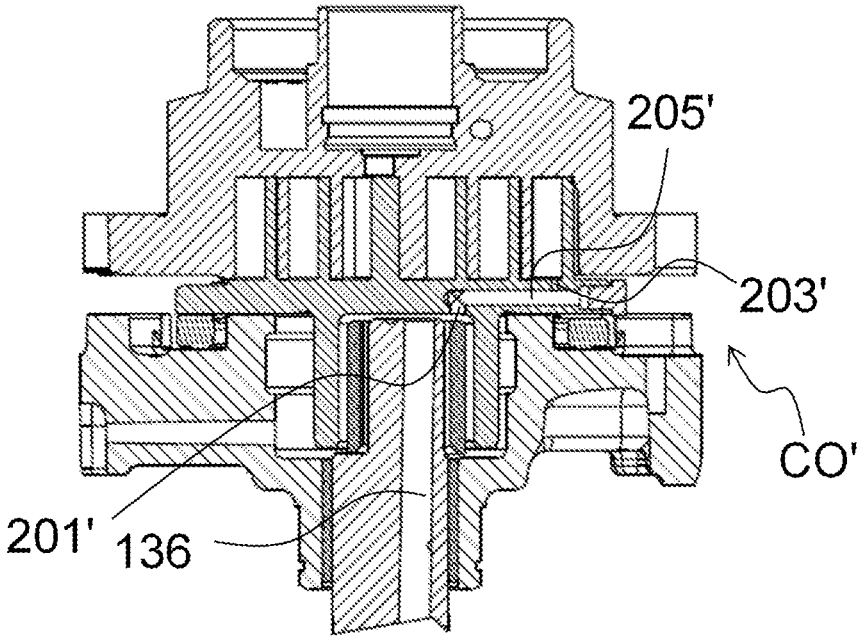
Prior Art Fig. 7
FIG. 7 is a longitudinal sectional view showing a part of a scroll compressor to which a compression mechanism oil supply device according to the related art is applied.
Figure 8:
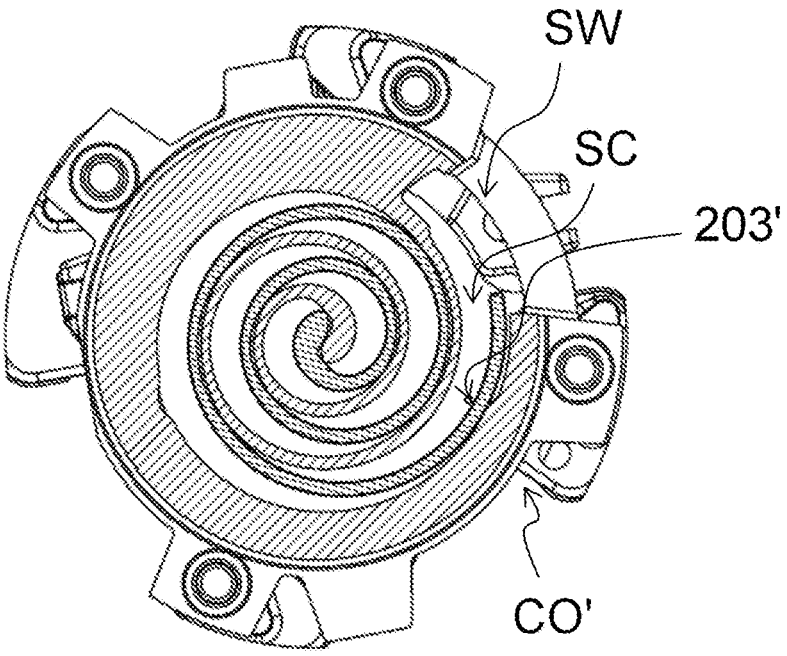
Prior Art Fig. 8
FIG. 8 is a cross sectional view showing a compression mechanism to which a compression mechanism oil supply device according to the related art is applied.

A compression mechanism oil supply device CO' of the lubrication system according to the related art is described with reference to FIGS. 6 to 8 (FIG. 6 is a schematic diagram showing exemplary parameter ranges of an exemplary cooling system, FIG. 7 shows a longitudinal sectional view showing a part of a scroll compressor to which a compression mechanism oil supply device according to the related art is applied, and FIG. 8 is a cross sectional view showing a compression mechanism to which a compression mechanism oil supply device according to the related art is applied).

Reference is made particularly to FIG. 7, and the compression mechanism oil supply device CO' according to the related art includes: an inlet hole 201' in communication with the lubricant storage area OA; an outlet hole 203' in communication with an appropriate area of the suction accommodating chamber SC; and a transverse hole 205' in communication with both the inlet hole 201' and the outlet hole 203'. The inlet hole 201', the outlet hole 203' and the transverse hole 205' may be formed in the orbiting scroll base plate 152. In some examples, the position of an opening of the outlet hole 203' in an upper surface of the orbiting scroll base plate 152 is disposed such that the outlet hole 203' is enabled to supply oil to an inner suction accommodating chamber SC at a radial inner side of the orbiting scroll 154 and an outer suction accommodating chamber at a radial outer side of the orbiting scroll 154, and it is possible to prevent the opening of the outlet hole 203' from being in the compression accommodating chamber in the orbiting cycle of the orbiting scroll set 150 so as to prevent the lubricant in the compression mechanism oil supply device CO' from returning to the lubricant storage area OA under the action of a high pressure in the compression accommodating chamber.

According to the inventors' studies and experiments, when the evaporation temperature is in the range of −40° F. to 0° F., the oil circulation rate (OCR), which can ensure, for example, forming a desired oil film at the tip of the scroll, ranges from 0.05% to 1%, and when the evaporation temperature is in the range of 0° F. to 45° F., the oil circulation rate (OCR), which can ensure, for example, forming a desired oil film at the tip of the scroll, ranges from 0.05% to 2%. In a certain experiment, the refrigerant R404A can be used and the displacement of the compression mechanism is 23CC.

In addition, referring to Table 1, it can be seen that in the case that an active oil injection mechanism for supplying oil to the compression mechanism is not provided, when the scroll compressor in the system is operated at a low speed of 2400 RPM and the system evaporation temperature/condensation temperature is set to −40/130° F., the oil circulation rate is 0.03% and below a lower limit of the desired range (i.e. 0.05%).

In addition, referring to Table 1, it can be seen that according to the related art, especially when the scroll compressor in the system is operated at a low speed of 2400 RPM, and the system evaporation temperature/condensation temperature is set to −40/130° F. or −20/90° F., the oil circulation rate is much higher than an upper limit of the desired range (i.e. 1%), no matter how these three sizes A, B and C are adjusted. In particular, even in the case that the sizes A and B are both set to be only 1.0 mm, the oil circulation rates are still much higher than the upper limit of the desired range at low evaporation temperature/low compressor rotational speed. Here, it should be understood that the passage having a smaller inner diameter (e.g., less than 1.0 mm) intended to reduce the oil circulation rate is difficult to machine and is substantially impossible to achieve.

TABLE 1

| | Oil Supply Design | | | | Oil Circulation Rate | | | |
|---|---|---|---|---|---|---|---|---|
| | | | | | −40/130° F. | −20/90° F. | 45/100° F. | 45/140° F. |
| Item | A (mm) | B (mm) | C (mm) | D (mm) | 2400 RPM | 2400 RPM | 6000 RPM | 6000 RPM |
| | No Oil Injection Mechanism | | | | 0.03% | 0.09% | 1.68% | 1.31% |
| Related Art | 3.3 | 1.0 | 11.00 | Transverse | >4.66% | >3.99% | — | 2.2% |
| | 1.0 | 1.0 | 11.00 | Hole | >4.1% | >2.5% | 1.36% | 1.67% |
| | 1.0 | 1.0 | 8.25 | Without Radial Opening | 1.72% | 1.84% | 1.43% | 1.49% |
| The Present Application | 2.0 | 1 | 5.5 | 5 | 0.22% | 0.18% | 1.91% | 1.69% |
| | | | | | 0.28% | 0.19% | 1.55% | — |
| Desired Range of Oil Circulation Rate | | | | | 0.05% to 1% | | 0.05% to 2% | |

Note:

A represents an inner diameter of the inlet hole, B represents an inner diameter of the outlet hole, C represents the distance between the opening position of the inlet hole and, for example, the rotation center axis of the drive shaft, and D represents an inner diameter of a counterbore of a compression mechanism oil supply device according to a second embodiment of the present application.

In this way, when the scroll compressor is operated, since the pressure of the lubricant storage area OA is higher than the pressure of the suction accommodating chamber SC (corresponding to the suction pressure), and since the volume of the suction accommodating chamber SC may be gradually increased in the air intake stage so that the pressure is further reduced, the lubricant can be smoothly conveyed to the compression mechanism CM.

In addition, referring to FIG. 6, it shows the rotational speed range, the condensation temperature range and the evaporation temperature range of the exemplary cooling system, which, for example, relates to the freezing application and employs a variable speed compressor. In addition, Accordingly, the compression mechanism oil supply device CO' according to the related art can hardly make the oil circulation rate within an appropriate range at different compressor rotational speeds and/or under different system operating parameters. In particular, the oil circulation rate significantly exceeds the upper limit of the desired range at low evaporation temperature/low compressor rotational speed. Thus, for example, an excessively high oil circulation rate may cause the lubricant to be accumulated around the discharge valve assembly 192 so as to cause certain issues to the scroll compressor.

Figure 2:
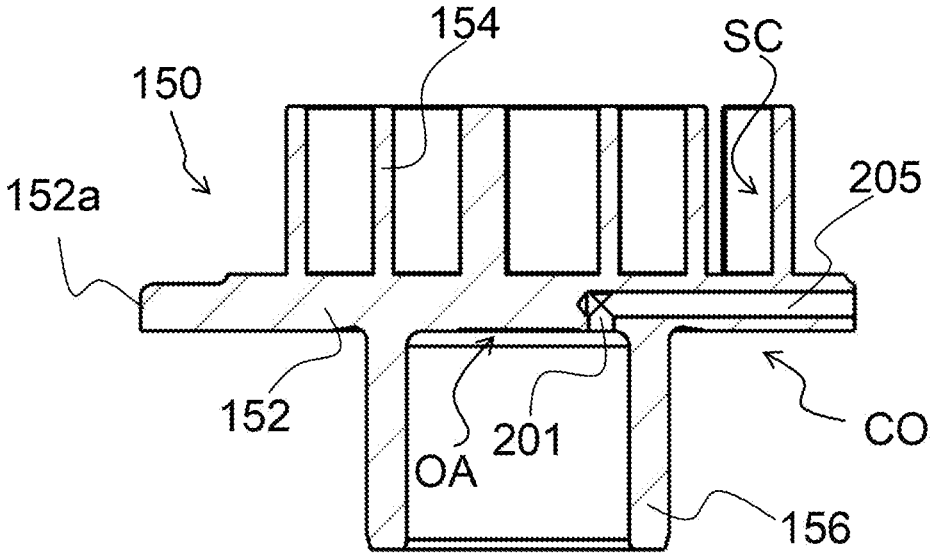
FIG. 2 is a longitudinal sectional view showing an orbiting scroll set incorporating a compression mechanism oil supply device according to a first embodiment of the present application.
Figure 3:
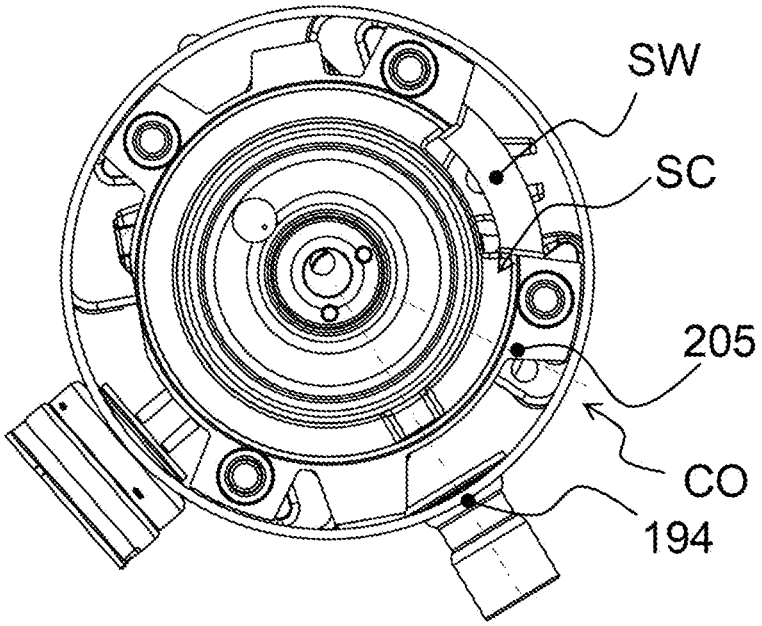
FIG. 3 is a cross sectional view showing a compression mechanism incorporating the compression mechanism oil supply device according to the first embodiment of the present application.
Figure 4A:
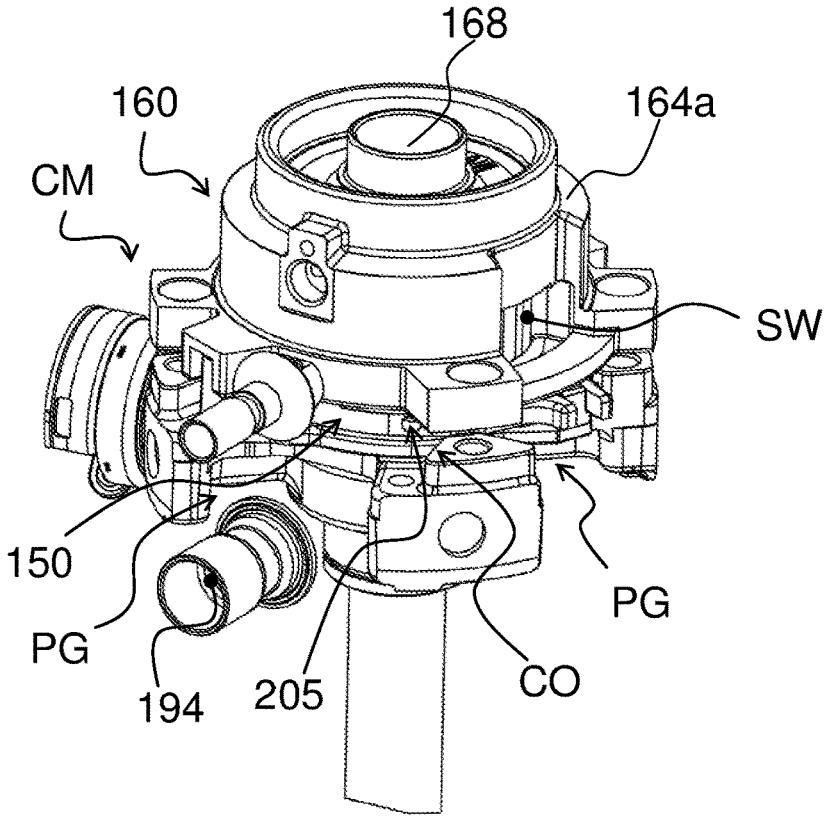
FIG. 4A is a perspective view showing a part of a scroll compressor incorporating the compression mechanism oil supply device according to the first embodiment of the present application.

A compression mechanism oil supply device CO of a lubrication system according to a first embodiment of the present application is described with reference to FIGS. 2 to 4A (FIG. 2 is a longitudinal sectional view showing an orbiting scroll set incorporating the compression mechanism oil supply device according to the first embodiment of the present application, FIG. 3 is a cross sectional view showing a compression mechanism incorporating the compression mechanism oil supply device according to the first embodiment of the present application, and FIG. 4A is a perspective view showing a part of a scroll compression incorporating the compression mechanism oil supply device according to the first embodiment of the present application).

Reference is particularly made to FIG. 2, and the compression mechanism oil supply device CO according to the first embodiment of the present application may include an inlet hole 201 in communication with the lubricant storage area OA and a transverse hole 205 in communication with the inlet hole 201. The inlet hole 201 and the transverse hole 205 may be formed in the orbiting scroll base plate 152. In some examples, the inlet hole 201 is an axial hole extending in the axial direction. However, it is conceivable that the inlet hole 201 may also be an oblique hole inclined with respect to the axial direction. In some examples, the transverse hole 205 is a horizontal hole extending in a radial direction of the compressor. However, it is conceivable that the transverse hole 205 may also be an oblique hole inclined with respect to the radial direction (horizontal direction). Here, it should be noted that the inlet hole 201 and the transverse hole 205 constitute the oil supply passage according to the present application.

The transverse hole 205 may be a hole having a constant inner diameter, and is opened in an outer peripheral surface 152*a* of the orbiting scroll base plate 152. In some examples, the inner diameter of the transverse hole 205 may be 3.3 mm.

In a preferred example, the opening position of the opening (the position of the outflow opening) of the transverse hole 205 in the outer peripheral surface 152*a* is disposed to be located in the flow path of the suctioned low pressure working fluid. In particular, the opening position is between the suction fitting 194 and the suction window SW.

In some examples, as shown in FIG. 3, the opening position is located between the suction fitting 194 (specifically, an opening of the suction fitting 194 provided in the inner peripheral wall of the shell body 112) and the suction window SW in a circumferential direction of the compressor, and/or, as shown in FIG. 4A, the opening position is located between the suction fitting 194 and the suction window SW in the axial direction.

In some examples, in the circumferential direction, the distance of the opening position from the suction fitting 194 is less than the distance of the opening position from the suction window SW, and/or, in the axial direction, the distance of the opening position from the suction fitting 194 is greater than the distance of the opening position from the suction window SW.

In general, the distance of the opening position from the suction fitting 194 may be less than the distance of the opening position from the suction window SW along the flow path of the working fluid. With such arrangement, it is advantageous to realize the oil supply target and concept of taking oil on demand.

In some examples, the opening position is close to or aligning to the suction fitting 194 in the circumferential direction.

In some examples, the opening position of the transverse hole 205 is located on a connecting line connecting the opening of the suction fitting 194 to the suction window SW.

In the illustrated example, the suction fitting 194 is arranged at a position substantially aligning to the main bearing housing 180 in the axial direction. In a preferred example, the suction fitting 194 is arranged to align to the main bearing passage PG. With such arrangement, the introduction of the low pressure working fluid is facilitated and the meeting of the lubricant discharged from the driven scroll base plate 152 with the low pressure working fluid suctioned from the suction fitting 194 is facilitated, thereby facilitating achieving the appropriate oil circulation rate. However, it is contemplated that the suction fitting 194 may also be arranged in other positions (e.g., the so-called bottom air intake design) in the axial direction.

Figure 5:
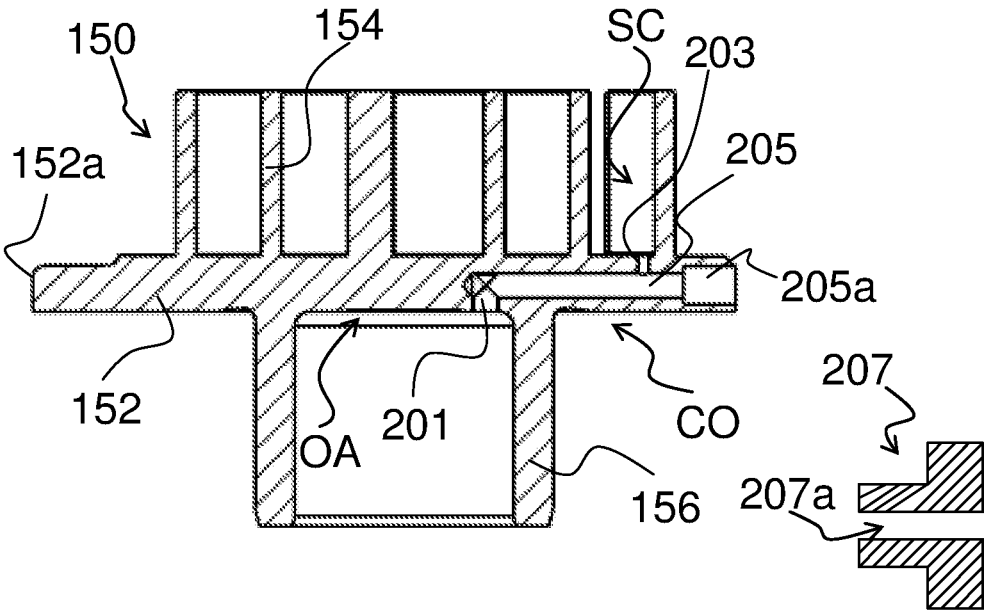
FIG. 5 is a longitudinal sectional view showing an orbiting scroll set incorporating a compression mechanism oil supply device according to a second embodiment of the present application.

The compression mechanism oil supply device CO of the lubrication system according to the second embodiment of the present application is described with reference to FIG. 5 (FIG. 5 is a longitudinal sectional view showing an orbiting scroll set incorporating the compression mechanism oil supply device according to the second embodiment of the present application).

With reference to FIG. 5, the main differences of the compression mechanism oil supply device CO according to the second embodiment of the present application from the compression mechanism oil supply device CO according to the first embodiment of the present application lie in that the transverse hole 205 may include a counterbore 205*a* located at its radial outer section, and the counterbore 205*a* may have an inner diameter greater than the inner diameter of the remaining section of the transverse hole 205 (for example, the inner diameter of the counterbore 205*a* may be 5 mm). In some examples, additionally, the compression mechanism oil supply device CO according to the second embodiment of the present application further differs from the compression mechanism oil supply device CO according to the first embodiment of the present application in that it further includes an outlet hole 203 (axial hole or oblique hole) in communication with an appropriate area of the suction accommodating chamber SC.

The compression mechanism oil supply device CO of the lubrication system according to the modification of the second embodiment of the present application is described below. In this modification, a plug 207 is provided. The plug 207 is adapted to be connected to the counterbore 205*a* (e.g., by threaded connection). A through hole 207*a* may be provided in the plug 207, and the through hole 207*a* may have an appropriate inner diameter. In some examples, the inner diameter of the through-hole 207*a* may be less than the inner diameter of the remaining section of the transverse hole 205. In other examples, the inner diameter of the through-hole 207*a* may be equal to or even greater than the inner diameter of the remaining section of the transverse hole 205.

Accordingly, the compression mechanism oil supply device according to the present application actively causes the lubricant expelled to meet the suctioned low pressure working fluid when the lubricant from the lubricant storage area OA is discharged out of the orbiting scroll base plate 152 from the opening of the transverse hole 205 during the operation of the scroll compressor, so that the low pressure working fluid can bring a portion of the lubricant into the compression mechanism CM. In this way, the oil supply target and concept of taking oil on demand (that is, the so-called taking depending on demand) are realized.

Specifically, on the one hand, for example, in the case of a low rotational speed condition, it is possible to increase the oil circulation rate to make it within a desired range as compared with a solution in which an active oil injection mechanism for supplying oil to the compression mechanism is not provided. On the other hand, for example, in the case of a high rotational speed condition, the oil circulation rate will not be excessively increased (basically the oil circulation rate may be only slightly increased) and may be kept within a desired range (for example, this is because at a high rotational speed, the mass of the lubricant discharged from the orbiting scroll base plate is relatively small at each revolution of the compression mechanism). Thereby, the oil circulation rate can be made within an appropriate range at different compressor rotational speeds and/or under different system operation parameters. In particular, it is possible to effectively prevent the oil circulation rate from significantly exceeding the upper limit of the desired range at a low evaporation temperature/low compressor rotational speed. Therefore, it is possible to avoid an excessive oil circulation rate which causes the lubricant to accumulate around the discharge valve assembly and brings stability and reliability issues to the scroll compressor.

At the same time, the remaining lubricant discharged from the orbiting scroll base plate 152 will fall down to the oil sump OR, and in this process it is also possible to effectively lubricate parts such as the Oldham 199 that require lubrication.

In addition, the compression mechanism oil supply device according to the second embodiment of the present application and the modification thereof: may facilitate reducing the speed at which the lubricant being expelled from the orbiting scroll base plate and improving the mist-like spraying of the lubricant by providing the counterbore; allows the lubricant to be directly conveyed to the suction accommodating chamber SC, i.e., the compression mechanism CM by additionally providing the outlet hole, thereby appropriately improving the oil circulation rate; and may improve the degree of freedom of adjustment of the oil circulation rate by alternatively providing a plug having a through hole.

In summary, by providing a counterbore having a larger inner diameter, by providing an outlet hole and/or by providing a plug having a through hole with a smaller inner diameter, the compression mechanism oil supply device according to the second embodiment of the present application and the modification thereof can sufficiently improve the adjustment accuracy and design freedom of the oil circulation rate, thereby enabling the compression mechanism oil supply device to have a more excellent versatility and applicability.

Referring again to Table 1, it can be seen that for the compression mechanism oil supply device according to the second embodiment of the present application, the oil circulation rates are within a desired range no matter at a low evaporation temperature/low compressor rotational speed or at a high evaporation temperature/high compressor rotational speed. In addition, in the second embodiment, the lubricant discharged from the outlet hole 203 is generally small (particularly in the case where the plug 207 is not provided), and therefore, the experimental results of the oil circulation rates in Table 1 are also applicable to the first embodiment.

The compression mechanism oil supply device according to the present application is particularly suitable for being used in variable speed compressors, particularly in variable speed compressors applied in freezing systems. However, the compression mechanism oil supply device with an excellent versatility according to the present application can also be applied to a series of constant speed compressors having different rotational speeds.

The compression mechanism oil supply device according to the present application can allow for a variety of different variations.

The suction window may be two or more, and/or the outflow opening of the oil supply passage may be two or more. In addition, the suction window may also be formed in a different manner from being disposed on the annular outer wall 164*a* of the non-orbiting scroll 164 as described above.

Figure 4B:
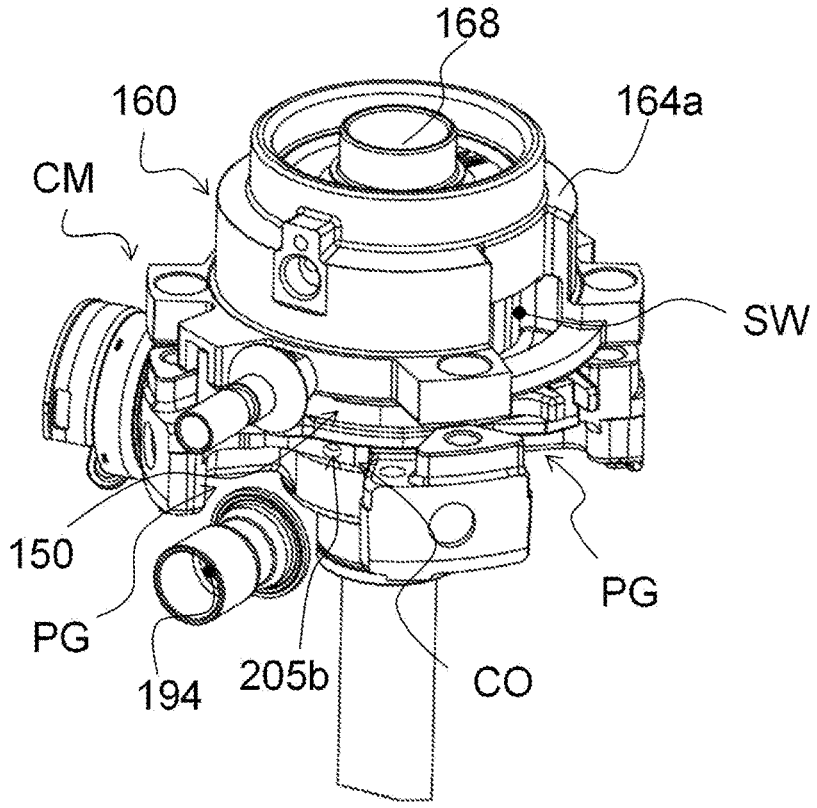
FIG. 4B is a perspective view showing a part of a scroll compressor incorporating the compression mechanism oil supply device according to a variation of the present application.

The oil supply passage of the compression mechanism oil supply device CO may be formed in other manners. For example, FIG. 4B shows a variation of the compression mechanism oil supply device CO according to the present application. As shown in FIG. 4B, the oil supply passage of the compression mechanism oil supply device CO is formed in the peripheral wall of the main bearing housing and the outflow opening 205*b* of the oil supply passage is opened to the outer peripheral surface of the peripheral wall of the main bearing housing. In this case, the lubricant storage area (lubricant source) may include a recessed portion of the main bearing housing configured to accommodate, for example, the hub portion 150. As another example, the oil supply passage is embodied as an oil tube extending directly from the oil sump to a position between the suction fitting and the suction window.

In summary, in the scroll compressor according to the present application, the following advantageous solutions may be included.

In the scroll compressor according to the present application, the outflow opening is located on a working fluid flow path extending from the opening of the suction fitting to the suction window.

In the scroll compressor according to the present application, the distance of the outflow opening from the opening of the suction fitting is less than the distance of the outflow opening from the suction window along the working fluid flow path.

In the scroll compressor according to the present application, the orbiting scroll set includes an orbiting scroll base plate, and the oil supply passage is formed in the orbiting scroll base plate.

In the scroll compressor according to the present application, the outflow opening is open to an outer peripheral surface of the orbiting scroll base plate.

In the scroll compressor according to the present application, the lubricant source includes a lubricant storage area, and the lubricant storage region is located at and near an end face of an eccentric pin of the drive shaft, and the oil supply passage includes an inlet hole in communication with the lubricant storage area and a transverse hole in communication with the inlet hole and having the outflow opening.

In the scroll compressor according to the present application, the transverse hole includes a counterbore located at its radial outer section, and the counterbore has an inner diameter greater than an inner diameter of the remaining section of the transverse hole.

In the scroll compressor according to the present application, the compression mechanism oil supply device further includes a plug, the plug is adapted to be connected to the counterbore, and a through hole is provided in the plug.

In the scroll compressor according to the present application, the through hole has an inner diameter less than the inner diameter of the remaining section of the transverse hole.

In the scroll compressor according to the present application, the compression mechanism oil supply device further includes an outlet hole in communication with a suction accommodating chamber of the compression mechanism and in communication with the transverse hole.

In the scroll compressor according to the application, the lubrication system further includes an oil supply passage provided in the drive shaft, the lubricant source further includes an oil sump located at the bottom of an internal volume of the scroll compressor, and the lubricant flows from the oil sump to the lubricant storage area via the oil supply passage.

In the scroll compressor according to the present application, the non-orbiting scroll set includes an annular outer wall, and the suction window is provided in the annular outer wall.

In the scroll compressor according to the present application, the scroll compressor further includes a main bearing housing configured to support a part of the drive shaft and support the orbiting scroll set, and the suction fitting is arranged at a position substantially aligning to the main bearing housing in an axial direction of the scroll compressor.

In the scroll compressor according to the present application, the main bearing housing has multiple radial projections spaced apart circumferentially and the main bearing housing is fixedly connected to an inner peripheral wall surface of a shell body of the scroll compressor by means of the radial projections, such that multiple main bearing housing passages are formed between the main bearing housing and the inner peripheral wall surface, and the suction fitting is arranged to align to the main bearing housing passage.

In the scroll compressor according to the present application, the scroll compressor further includes a main bearing housing configured to support a part of the drive shaft and support the orbiting scroll set, and the oil supply passage is formed in a peripheral wall of the main bearing housing and is opened to an outer peripheral surface of the peripheral wall of the main bearing housing.

In the scroll compressor according to the present application, the scroll compressor is a variable speed compressor suitable for being applied in a freezing system.

In this application, use of the locality terms "top", "bottom", "upper" and "lower" and the like is for illustrative purpose only and is not to be regarded as limiting.

While the present application has been described with reference to the exemplary embodiments, it is to be understood that the present application is not limited to the specific embodiments described and illustrated in detail herein. The person skilled in the art can make various variants to the exemplary embodiments without departing from the scope defined by the claims.

The invention claimed is:

1. A scroll compressor, comprising:

a compression mechanism adapted to compress a working fluid and comprising an orbiting scroll set, a non-orbiting scroll set and a suction window, the working fluid flowing into the compression mechanism via the suction window;

a drive mechanism comprising a drive shaft and adapted to drive the compression mechanism;

a suction fitting via which the working fluid flows into the scroll compressor and further flows to the compression mechanism; and a lubrication system comprising a lubricant source and a compression mechanism oil supply device adapted to supply a lubricant from the lubricant source to the compression mechanism, wherein the compression mechanism oil supply device has an oil supply passage, and an outflow opening of the oil supply passage is located between an opening of the suction fitting and the suction window, and the outflowing opening is between the suction fitting and the suction window in a peripheral direction of the scroll compressor.

2. The scroll compressor according to claim 1, wherein the outflow opening is located on a working fluid flow path extending from the opening of the suction fitting to the suction window.

3. The scroll compressor according to claim 2, wherein the distance of the outflow opening from the opening of the suction fitting is less than the distance of the outflow opening from the suction window along the working fluid flow path.

4. The scroll compressor according to claim 3, wherein the scroll compressor further comprises a main bearing housing configured to support a part of the drive shaft and support the orbiting scroll set, and the oil supply passage is formed in a peripheral wall of the main bearing housing and is opened to an outer peripheral surface of the peripheral wall of the main bearing housing.

5. The scroll compressor according to claim 2, wherein the scroll compressor further comprises a main bearing housing configured to support a part of the drive shaft and support the orbiting scroll set, and the oil supply passage is formed in a peripheral wall of the main bearing housing and is opened to an outer peripheral surface of the peripheral wall of the main bearing housing.

6. The scroll compressor according to claim 1, wherein the orbiting scroll set comprises an orbiting scroll base plate, and the oil supply passage is formed in the orbiting scroll base plate.

7. The scroll compressor according to claim 6, wherein the outflow opening is open to an outer peripheral surface of the orbiting scroll base plate.

8. The scroll compressor according to claim 7, wherein the lubricant source comprises a lubricant storage area, and the lubricant storage region is located at and near an end face of an eccentric pin of the drive shaft, and the oil supply passage comprises an inlet hole in communication with the lubricant storage area and a transverse hole in communication with the inlet hole and having the outflow opening.

9. The scroll compressor according to claim 8, wherein the transverse hole comprises a counterbore located at its radial outer section, and the counterbore has an inner diameter greater than an inner diameter of the remaining section of the transverse hole.

10. The scroll compressor according to claim 9, wherein the compression mechanism oil supply device further comprises a plug, the plug is adapted to be connected to the counterbore, and a through hole is provided in the plug.

11. The scroll compressor according to claim 10, wherein the through hole has an inner diameter less than the inner diameter of the remaining section of the transverse hole.

12. The scroll compressor according to claim 9, wherein the compression mechanism oil supply device further comprises an outlet hole in communication with a suction accommodating chamber of the compression mechanism and in communication with the transverse hole.

13. The scroll compressor according to claim 9, wherein the lubrication system further comprises an oil supply passage provided in the drive shaft, the lubricant source further comprises an oil sump located at the bottom of an internal volume of the scroll compressor, and the lubricant flows from the oil sump to the lubricant storage area via the oil supply passage.

14. The scroll compressor according to claim 10, wherein the lubrication system further comprises an oil supply passage provided in the drive shaft, the lubricant source further comprises an oil sump located at the bottom of an internal volume of the scroll compressor, and the lubricant flows from the oil sump to the lubricant storage area via the oil supply passage.

15. The scroll compressor according to claim 8, wherein the lubrication system further comprises an oil supply passage provided in the drive shaft, the lubricant source further comprises an oil sump located at the bottom of an internal volume of the scroll compressor, and the lubricant flows from the oil sump to the lubricant storage area via the oil supply passage.

16. The scroll compressor according to claim 1, wherein the non-orbiting scroll set comprises an annular outer wall, and the suction window is provided in the annular outer wall.

17. The scroll compressor according to claim 1, wherein the scroll compressor further comprises a main bearing housing configured to support a part of the drive shaft and support the orbiting scroll set, and the suction fitting is arranged at a position substantially aligning to the main bearing housing in an axial direction of the scroll compressor.

18. The scroll compressor according to claim 17, wherein the main bearing housing has a plurality of radial projections spaced apart circumferentially and the main bearing housing is fixedly connected to an inner peripheral wall surface of a shell body of the scroll compressor by means of the radial projections, such that a plurality of main bearing housing passages are formed between the main bearing housing and the inner peripheral wall surface, and the suction fitting is arranged to align to the main bearing housing passage.

19. The scroll compressor according to claim 1, wherein the scroll compressor further comprises a main bearing housing configured to support a part of the drive shaft and support the orbiting scroll set, and the oil supply passage is formed in a peripheral wall of the main bearing housing and is opened to an outer peripheral surface of the peripheral wall of the main bearing housing.

20. The scroll compressor according to claim 1, wherein the scroll compressor is a variable speed compressor suitable for being applied in a freezing system.

* * * * *